United States Patent [19]

Higuchi et al.

[11] Patent Number: 4,907,279

[45] Date of Patent: Mar. 6, 1990

[54] PITCH FREQUENCY GENERATION SYSTEM IN A SPEECH SYNTHESIS SYSTEM

[75] Inventors: Norio Higuchi; Seiichi Yamamoto, both of Saitama; Toru Shimizu, Tokyo, all of Japan

[73] Assignee: Kokusai Denshin Denwa Co., Ltd., Tokyo, Japan

[21] Appl. No.: 217,520

[22] Filed: Jul. 11, 1988

[30] Foreign Application Priority Data

Jul. 31, 1987 [JP] Japan ..... 62-190387

[51] Int. Cl.[4] ..... G10L 5/02

[52] U.S. Cl. ..... 381/52

[58] Field of Search ..... 381/51–53, 381/36–40; 364/513.5

[56] References Cited

U.S. PATENT DOCUMENTS 3,704,345 11/1972 Coker et al. ..... 381/52

4,692,941 9/1987 Jacks et al. ..... 381/52

OTHER PUBLICATIONS

"Analysis of Voice Fundamental Frequency Contours for Declarative Sentences in Japanese", Hiroya Fujisaki et al, J. Acoust. Soc. Japan, (E) 5, 4 (1984).

"Software for a Cascade/Parallel Format Synthesizer", J. Acoust. Soc. Am., 67, pp. 971–995, (1980).

*Primary Examiner*—Gary V. Harkcom

*Assistant Examiner*—John Merecki

*Attorney, Agent, or Firm*—Armstrong, Nikaido, Marmelstein, Kubovcik & Murray

[57] ABSTRACT

A speech synthesis system comprises an input terminal for accepting text code, accent code, and phrase code. The speech synthesis system further comprises a converter for converting the text code to speech parameters for speech synthesis; an accent commend generator coupled to an output of the converter for providing a train of accent commands; a phrase command generator coupled to an output of the converter for providing a train of phrase commands; an accent command buffer for storing the accent commands; a phrase command buffer for storing the phrase commands; an accent component calculator operably coupled to the accent command buffer for providing contour of pitch frequency by accent component; a phrase component calculator operably coupled to the phrase command buffer for providing contour of pitch frequency by phrase component; an adder for providing a sum of output signals from the accent component calculator and the phrase component calculator; a device for providing fundamental frequency of voicing which is coupled to an output of the adder; a speech synthesizer coupled to an output of the device for providing the fundamental frequency and output of the converter; and an output terminal coupled to an output of the speech synthesizer for providing synthesized speech to an external circuit.

10 Claims, 3 Drawing Sheets

FIRST PORTION

| TIME (ADDRESS) | CONTENT |
|---|---|
| $t_1$ | $p_1$ |
| $t_2$ | $p_2$ |
| $t_3$ | $p_3$ |
| ----- | ----- |
| $t_n$ | $p_n$ |

SECOND PORTION

| VALUE (ADDRESS) | END POINT |
|---|---|
| 1 | $M_1$ |
| 2 | $M_2$ |
| --- | --- |
| $P_{n-2}$ | $M_{pn-2}$ |
| $P_{n-1}$ | $M_{pn-1}$ |
| $P_n$ | $M_{pn}$ |

PITCH FREQUENCY GENERATION SYSTEM IN A SPEECH SYNTHESIS SYSTEM

BACKGROUND OF THE INVENTION

The present invention relates to a speech synthesizer, in particular, relates to a pitch frequency control system in a speech synthesizer, having an accent and intonation (or phrase) arbitrarily adjustable for synthesizing smooth and natural synthesized speech.

Speech is synthesized by using speech parameters, including formant frequencies, formant bandwidths, voice source amplitude and pitch frequency.

In a conventional speech synthesis system, pitch frequency in each syllable is defined by the pitch frequency at a particular time point in the syllable. Also, the pitch frequency between those particular time point is calculated with an interpolation calculation between two adjacent pitch frequencies.

However, the above prior art has the disadvantage that the accent of each word is not adjustable because the accent component of each word is not separated from a phrase component or an intonation.

Another prior art which overcomes the above disadvantage is shown in "Analysis of Voice Fundamental Frequency Contours for Declarative Sentences of Japanese" by Hiroya Fujisaki, et al, in J.Acoust. Soc. Jpn (E) 5,4 (1984), pages 233–242, which can adjust a rapid accent component, and a slow phrase component, independently from each other. So, it becomes possible to provide a desired accent level and a desired phrase level.

However, said system by Fujisaki has the disadvantage of having the calculation for pitch frequency being too complicated for most usable sized hardware, since it must perform time consuming complicated exponential calculations for providing the pitch frequency at a particular instant.

SUMMARY OF THE INVENTION

It is an object, therefore, of the present invention to overcome the disadvantages and limitations of a prior speech synthesis system by providing a new and improved speech synthesis system.

It is also an object of the present invention to provide a pitch frequency control system in a speech synthesis system, in which smooth and natural speech is synthesized by adjusting the accent component and phrase component independently by using simple hardware for simple calculations.

The above and other objects are attained by a speech synthesis system having an input terminal 1 for accepting text code including spelling of a word, together with accent code, and phrase code; means (2) for converting said text code to speech parameters for speech synthesis; an accent command generator (3) coupled with output of said means (2) for providing a train of accent commands, each of which is defined by start point time, end point time, and amplitude of a command pulse; a phrase command generator (5) coupled with output of said means (2) for providing a train of phrase commands, each of which is defined by time and amplitude of each phrase command; an accent command buffer (**3*a*) for storing said accent commands; a phrase command buffer (5*a*) for storing said phrase commands; an accent component calculator (4) for providing contour of pitch frequency by accent component; a phrase component calculator (6) for providing contour of pitch frequency by phrase component; an adder (20) for providing sum of outputs of said accent component calculator (4) and said phrase component calculator (6); means (7) for providing fundamental frequency of voicing coupled with output of said adder (20); a speech synthesizer (20) coupled with output of said means (7) and output of said means (2) for providing synthesized speech; and an output terminal (9) coupled with output of said speech synthesizer (8) for providing synthesized speech to an external circuit; said accent command calculator (4) comprising at least one accent table storing response for a step function; and said phrase component calculator (6) comprising a single phrase table storing impulse response for a unit amplitude, and a multiplier (6*a***) for providing product of output of said phrase command and amplitude of each phrase command.

BRIEF DESCRIPTION OF THE DRAWINGS

The foregoing and other objects, features, and attendant advantages of the present invention will be appreciated as the same become better understood by means of the following description and accompanying drawings.

DESCRIPTION OF THE PREFERRED EMBODIMENTS

According to the present invention, accent and intonation (or phrase) are designated independently from each other according to an accent code and a phrase code of a word. Accent of a pitch frequency is implemented by using a plurality of accent tables, and an intonation (or phrase) is implemented by using a single phrase table. The accent component is the sum of the outputs of said accent tables, and the phrase component is the sum of the product of the output of said phrase table and the amplitude of each phrase command.

Figure 1:
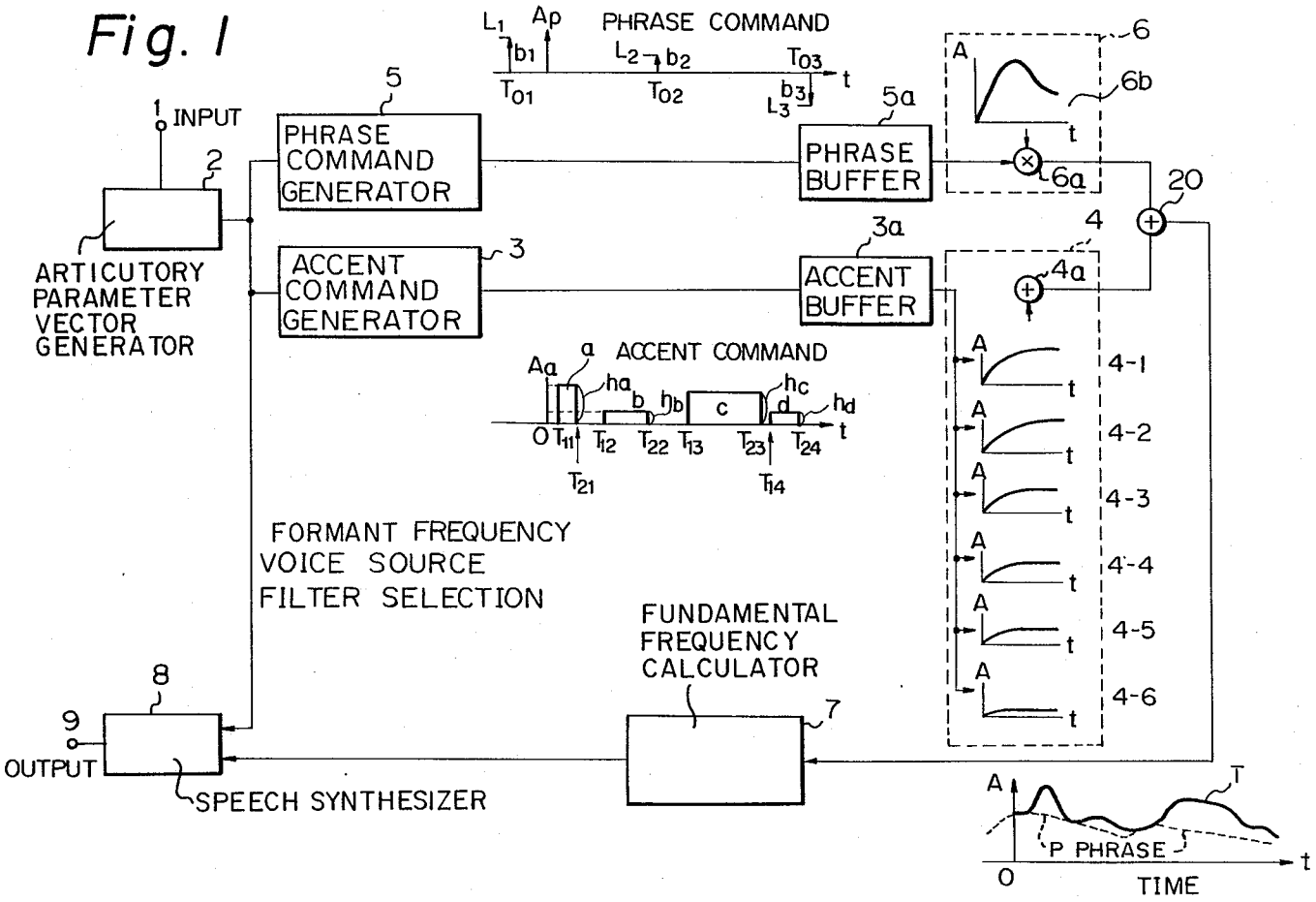
FIG. 1 is a block diagram of a pitch frequency control system in a speech synthesizer according to the present invention, FIGS. 2(*a*) through 2(*e*) show operational curves of the accent component generator and the phrase component generator.

FIG. 1 is a block diagram of the speech synthesizer according to the present invention. In FIG. 1, the numeral 1 designates an input terminal which accepts text code including character trains with spelling, accent code, and phrase and reference numeral, 2 is an articutory parameter vector generator which determines speech parameters including formant frequencies, formant bandwidths, voice source amplitude, accent code, and phrase code. An accent code is applied to the accent command generator 3, while a phrase code is applied to the phrase command generator 5. Other components of the outputs of the articutory parameter vector generator 2 are applied directly to the speech synthesizer 8. The numeral **3*a* is an accent command buffer which stores accent commands generated by the accent command generator 3, and the reference numeral 5*a*** is the phase command buffer for storing the phase commands.

The reference numeral 4 is an accent component calculator which has an adder **4*a* and a plurality of accent tables 4-1 through 4-6**.

The reference numeral 6 is a phrase component calculator which has a multiplier 6a and a single phrase table 6b. The outputs of the accent component calculator 4 and the phrase component calculator 6 are added to each other in the adder 20.

The reference numeral 7 is the calculator of the fundamental frequency of voicing for providing an actual pitch frequency according to the outputs of said accent component calculator 4 and said phrase component calculator 6 through the adder 20. The numeral 8 is a speech synthesizer for providing an actual speech signal. The speech synthesizer 8 may be either a formant type speech synthesizer or a "PARCOR" type speech synthesizer, so long as it matches with output signals of said articutory parameter vector generator 2. The numeral 9 is an output terminal coupled with output of said speech synthesizer 8, for providing the synthesized speech signal to an external circuit.

The text code at the input terminal 1 includes an accent code, and a separation code for showing the end of a word and a phrase. The articutory parameter vector generator 2 converts the input charcter train to a phonetic code train, determines the duration of each phonetic code, and determines the speech parameters for each phonetic code. Any kind of speech parameters are applicable, so long as they match with the structure of the speech synthesizer 8. The manner of selection of the speech parameters may be done either by the calculation according to rule (Proceeding of the autumn meeting of the Acoustical Society of Japan, pages 185–186, 1985 "Experimental System on Speech Synthesis from Concept" by Yamamoto, Higuchi, and Matsuzaki), or by the concatenation system of feature, vector, elements (The Journal of the Institute of Electronics and Communication Engineers, 61-D, pages 858–865, 1978 "Speech Synthesis on the Basis of PARCOR-VCV Concatenation Units" by Sato).

The accent command generator 3 provides an accent command which synchronizes with the feature vectors of the output of the articutory parameter vector generator 2, according to the accent codes of the input text code.

An accent command is a step function, defined by three values, namely, start point time, end point time, and level (or amplitude) of a pulse. Since the feature vectors and the pitch frequency must be supplied to the speech synthesizer 8 in every predetermined frame interval (for instance 5 msec), it is preferable that the start point time and the end point time of each accent command are indicated by the number of frames. The accent commands generated by the accent command generator 3 are stored in the accent buffer 3a. In the embodiment of FIG. 1, a train of accent commands $a(T_{11}, T_{21}, h_a)$, $b(T_{12}, T_{22}, h_b)$, $c(T_{13}, T_{23}, h_c)$, and $d(T_{14}, T_{24}, h_d)$ are shown.

The accent component calculator 4 has the adder 4a, and a plurality of accent tables 4-1 through 4-6. The number of the accent tables is, for instance, six. The accent table is prepared for each level or amplitude ($h_i$) of an accent command, which is a step function. The content of each accent table is the exponential response for a step function for the input accent command with the particular amplitude. The response for a step function is conventional and is expressed as follows:

$$A_i=[1-(1+Bt)\exp(-Bt)]*h_i$$

where B is constant, $h_i$ is level of an accent command. The accent table is provided for each level $h_i$ of the accent command. The time constant (1/B) of the accent tables is common to all the accent tables and is predetermined depending upon each person, and is usually in the range between 15 msec and 30 msec. Since the accent component reaches the saturated level, which is the same level as the accent command in 100 frames, and returns to zero in 100 frames when the accent command stops, each accent table stores 100 accent commands, when frame length is 5 msec. Additionally, each accent command in the accent buffer is deleted in 100 frames (500 msec) after it is read out.

When the first accent command (a) is applied to the accent component calculator 4, one of the accent tables is selected according to the amplitude $h_a$ of the accent command (a), and the accent component for that accent command is provided according to the difference between the current frame number and the frame number of the start point time of the accent command, and the difference between the current frame number and the frame number of the end point time. Assuming that the accent table 4-1 is selected by the accent command (a) which has the amplitude $h_a$, the accent component is read out in the accent table 4-1 from the time $T_{11}$. Then, when the first accent command (a) finishes at time $T_{21}$, the accent component is the sum of the accent component starting at $T_{11}$, and the accent component starting at $T_{21}$, which is negative in the accent table 4-1.

Since each sentence has a plurality of accent commands, the accent component is the sum of accent components each of which is calculated by each accent command having a start point time, an end point time, and an amplitude. The sum is achieved by using the adder 4a.

The combination of the accent components will be described later in accordance with FIG. 2.

As a modification of the embodiment of FIG. 1, a single accent table and a multiplier are possible, instead of six accent tables and an adder 4a. When a single accent table which stores response for a unit step function is provided, the accent component is the product of the output of the accent table and the amplitude $h_i$ of the accent command.

The embodiment of FIG. 1, which has six accent tables is preferable, since it can omit frequent calculation of multiplication.

The phrase command generator 5 generates a phrase command which synchronizes with the change of the speech parameters provided by the articutory parameter vector generator 2, according to the separation code at the input terminal 1. The phrase command is indicated by the time and amplitude of impulse, because a phrase command is approximately by an impulse function.

The phrase commands in the embodiment are $b_1$(at time $T_{01}$ with amplitude $L_1$), $b_2$(at time $T_{02}$ with amplitude $L_2$), and $b_3$(at time $T_{03}$ with amplitude $L_3$). The data of the phrase commands (time $T_i$ and amplitude $L_i$) are stored in the phase buffer 5a.

The phrase component calculator 6 has a multiplier 6a and a table 6b. The table 6b stores the relations between the time (t) and the amplitude of the unit impulse response which is the impulse response for the input pulse having the unit(*1*) amplitude.

The impulse response is conventional, and is expressed as follows:

$$L=A^2t\exp(-At),$$

where (1/A) is a time constant.

The duration of a phrase component (impulse response) is rather long, and is, for instance, 4.5 second. However, the amplitude of the impulse response is high only at the initial stage, and reaches zero asymptotically.

Therefore, it is preferable that the table 6b stores the relations between the time and the amplitude of the impulse response only for the first portion where the amplitude is rather high.

Figure 3:
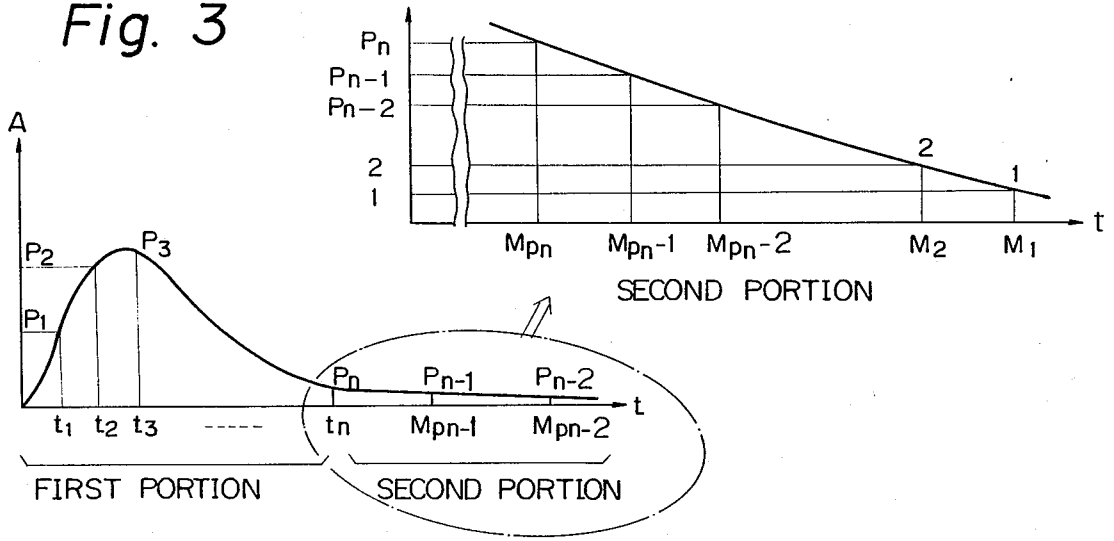
FIG. 3 shows the configuration of the table which is used for a phrase command generator.

FIG. 3 shows the configuration of the phrase buffer. In the first portion of the impulse response, the buffer stores the relations between $t_i$ and the amplitude of the impulse response. Therefore, the addresses $t_1$, $t_2$, $t_3$,..., $t_n$ store $p_1$, $p_2$, $p_3$,..., respectively, as shown in the FIG. 3. In the second portion where t is larger than $t_n$, the address n stores $M_n$ which is the end point time of the range where the value of the impulse response is n. The separation of the buffer into the first portion and the second portion saves the memory capacity.

The first portion having the relations between the time and the amplitude has for instance 500 values (or 2.5 second) with the interval being 5 msec, and the second portion storing the end point time for unit decrease of the impulse response has 4.5 seconds.

The multiplier 6a provides the product of the amplitude of each phrase command ($b_1$, $b_2$, $b_3$), and the output of the table 6b at each time.

A phrase command in the phrase buffer is deleted when all the data of the related phrase command has been read out.

In one embodiment, the time constant (1/A) of the impulse response in the phrase buffer is the same as the time constant (1/B) of the step function in the accent buffer.

Figure 2:
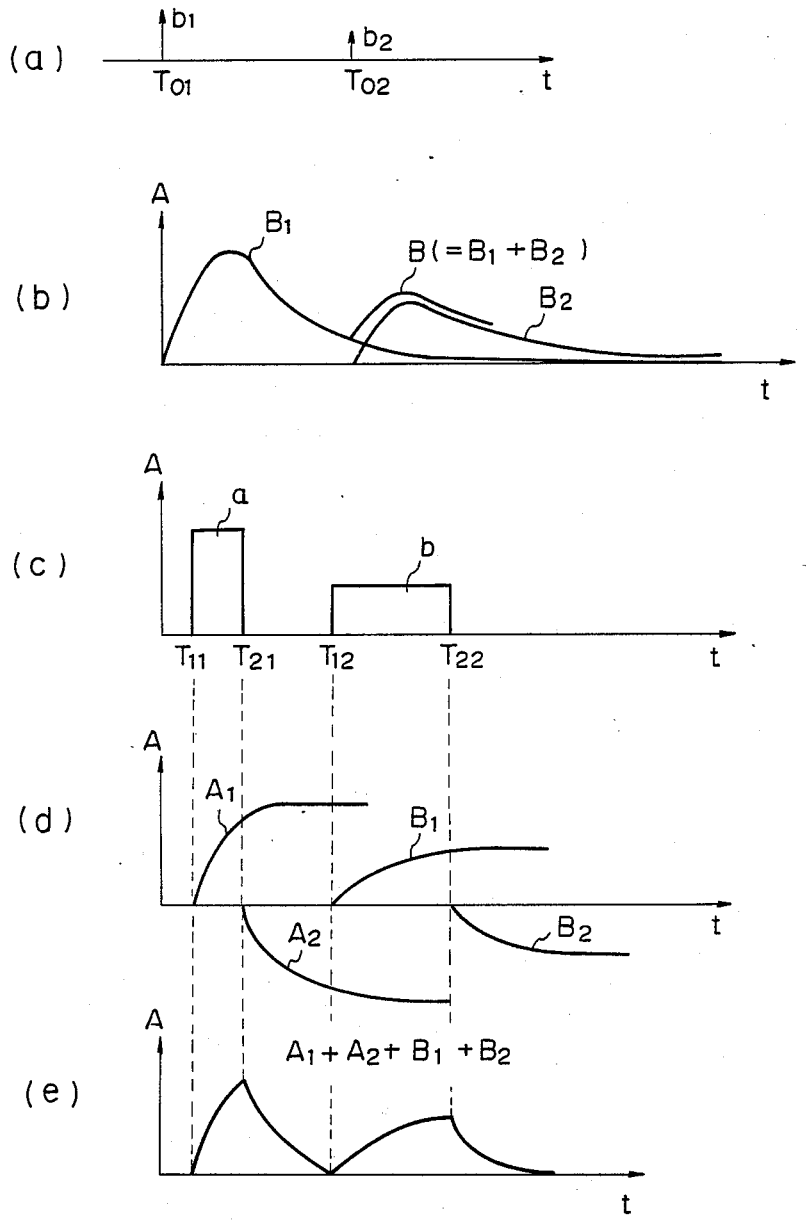

FIG. 2 shows the operation of the accent component calculator 4 and the phrase component calculator 6. In FIG. 2(*a*), the phrase commands $b_1$ and $b_2$ are shown. The curve $B_1$ in FIG. 2(*b*) is the impulse response to the phrase command $b_1$, and is equal to the product of the unit impulse response and the amplitude $b_1$. Similarly, the curve $B_2$ is the phrase response for the phrase command $b_2$. The total phrase component is the curve B which is the sum of the curves $B_1$ and $B_2$. FIG. 2(*c*) shows accent commands (a) and (b). The first accent command results in the accent component $A_1$ by the step-up portion, and the accent component $A_2$ by the step-down portion. Similarly, the accent command (b) causes the accent components $B_1$ and $B_2$. The total accent component is shown in FIG. 2(*e*), which is the sum of the curves $A_1$, $A_2$, $B_1$ and $B_2$.

The accent component (FIG. 2(*e*)) and the phrase component (curve B in FIG. 2(*b*)) are added to each other in the adder 20, thereby provided the adjusted pitch frequency to the actual pitch frequency calculator 7. The solid curve T in FIG. 1 shows the sum of the accent component and the phrase component, and the dotted curve P in FIG. 1 shows the phrase component.

The actual pitch frequency calculator 7 provides the actual pitch frequency, which is the product of the exponential of the output of the adder 20, and the reference pitch frequency ($F_{min}$) which depends upon each speaker.

The speech synthesizer 8 generates a speech, by using the output pitch frequency, together with the outputs of the articutory parameter vector generator 2. The speech synthesizer 8 itself is conventional, and may be either a formant type synthesizer, or a "PARCOR" type synthesizer. The example of a prior speech synthesizer is shown in "Software for a Cascade/Parallel Formant Synthesizer" by D.H.Klatt, J.Acoust. Soc. Am., 67, 971–995 (1980).

The synthesized speech in analog form is applied to the output terminal 9.

As described in the above detail, according to the present invention, the synthesis of speech of any language is possible with desired accents and desired intonations, merely by looking up tables. Therefore, no complicated exponential calculation is necessary. The simplified speech synthesizer which provides excellent speech quality is obtained by the present invention.

From the foregoing, it will now be apparent that a new and improved speech synthesizer has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A speech synthesis system, comprising: an input terminal means for accepting text code, said text code being at least a character train having spelling, accent code, and phrase code of each word;

generating means for receiving said text code from said input terminal means and for converting said text code to thereby generate speech parameters for speech synthesis;

an accent command generator means for receiving said accent code which is one of said speech parameters from said generating means, and for providing a train of accent commands, each accent command being defined by a start point time, an end point time, and an amplitude which define a step function;

a phrase command generator means for receiving said phrase code which is one of said speech parameters from said generating means, and for providing a train of phrase commands, each phrase command being defined by a time and an amplitude which define an impulse function;

an accent command buffer means for storing said accent commands;

a phrase command buffer means for storing said phrase commands;

an accent component calculator means coupled to said accent command buffer means for providing an output signal representing an accent component;

a phrase component calculator means coupled to said phrase command buffer means for providing an output signal representing a phrase component;

an adder means for providing a sum of said output signals from said accent component calculator means and said phrase component calculator means;

means for receiving said sum provided by said adder means, and for providing fundamental frequency of voicing;

a speech synthesizer means coupled to said means for providing said fundamental frequency and said generating means for providing synthesized speech; and an output terminal means coupled to said speech synthesizer means for providing said synthesized speech to an external circuit, wherein said accent component calculator means comprises at least one accent table which stores a response for a step function corresponding to at least one accent command from said accent command generator, wherein said accent component calculator means adds together step function responses stored in at least one accent table corresponding to at least one accent command received from said accent command buffer means and provides the result of the additional which is outputted as said output signal representing said accent component, and wherein said phrase component calculator means comprises a single phrase table for storing impulse response for a unit amplitude, and a multiplier means for providing a product of an output of said table and said amplitude of each phrase command from said phrase command generator, said product being outputted as said output signal representing said phrase component.

2. A speech synthesis system, according to claim 1, wherein said accent component calculator means has a plurality of accent tables, wherein each accent table is for storing a response for a step function according to said amplitude of an accent command, and an adder means for providing a sum of the outputs of said accent tables, said sum being outputted as said output signal representing said accent component.

3. A speech synthesis system, according to claim 2, wherein the number of accent tables in said accent command calculator means is six.

4. A speech synthesis system, according to claim 1, wherein said phrase table in said phrase component calculator means has a first portion, and a second portion which follows said first portion, said first portion stores relations between time and amplitude of an impulse response, and said second portion stores relations between n and $M_n$, where n is an address for $M_n$ and is an integer greater than zero, and $M_n$ is an end point time in which an impulse response decreases from n to n−1 by one unit.

5. A speech synthesis system, according to claim 1, wherein said start point time, and an said end point time of each accent command are defined by a number of frames which have a predetermined time duration.

6. A speech synthesis system according to claim 5, wherein, the predetermined time duration of each frame is 5 msec.

7. A speech synthesis system according to claim 1, wherein said accent command buffer means is for storing said accent commands for 500 msec.

8. A speech synthesis system according to claim 1, wherein said accent commands stored in said accent command buffer means are deleted after a predetermined time elapses, and a phrase command stored in said phrase buffer is deleted after another predetermined time elapses.

9. A speech synthesis system according to claim 1, wherein a time constant of said step function is the same as a time constant of said impulse function.

10. A speech synthesis system according to claim 9, wherein said time constants are between 15 msec and 30 msec.

* * * * *